United States Patent [19]

Puccio

[11] 4,437,785

[45] Mar. 20, 1984

[54] ELASTOMERIC SEALING MEMBER

[75] Inventor: Guy S. Puccio, Snyder, N.Y.

[73] Assignee: Acme Highway Products Corp., Amherst, N.Y.

[21] Appl. No.: 460,923

[22] Filed: Jan. 25, 1983

[51] Int. Cl.[3] ..... E01C 11/10

[52] U.S. Cl. ..... 404/64; 52/396; 277/205

[58] Field of Search ..... 404/64, 65, 66, 67, 404/68, 49, 47; 49/498, 475; 52/396, 403, 573; 277/205, 207 R

[56] References Cited

U.S. PATENT DOCUMENTS

| | | | |
|---|---|---|---|
| D. 247,373 | 2/1978 | Puccio | D25/75 |
| D. 247,374 | 2/1978 | Puccio | D25/75 |
| 3,179,026 | 4/1965 | Crone | 94/18 |
| 3,276,336 | 10/1966 | Crone | 94/18 |
| 3,482,492 | 12/1969 | Bowman | 94/18 |
| 3,485,149 | 12/1967 | Boney | 94/18 |
| 3,595,141 | 7/1971 | Boney et al. | 94/18 |
| 3,606,826 | 9/1971 | Bowman | 94/18 |
| 3,645,176 | 2/1972 | Berchou | 94/18 |
| 3,653,305 | 4/1972 | Trieste et al. | 94/18 |
| 3,687,022 | 8/1972 | Brown | 94/18 |
| 3,718,403 | 2/1973 | Kerschner | 94/18 |
| 3,762,826 | 10/1973 | Bowman | 404/64 |
| 3,881,834 | 5/1975 | Bowman | 404/64 |
| 3,899,260 | 8/1975 | Kerschner | 404/64 |
| 3,960,462 | 6/1976 | Kerschner | 404/64 |
| 4,018,539 | 4/1977 | Puccio | 404/69 |
| 4,043,693 | 8/1977 | Brown | 404/64 |
| 4,098,043 | 7/1978 | McCready | 52/403 |
| 4,362,428 | 12/1982 | Kerschner | 404/64 |

FOREIGN PATENT DOCUMENTS 466470 10/1975 Australia .

*Primary Examiner*—Ernest R. Purser
*Assistant Examiner*—Beverly E. Hjorth
*Attorney, Agent, or Firm*—Christel, Bean & Linihan

[57] ABSTRACT

An elastomeric seal member for sealing roadway and structural expansion joints. The seal member is of generally rectangular configuration and includes top, bottom, and side walls, the side walls being linear and the top and bottom walls including means to cause deflection thereof to occur in a downward direction. Internal support members include right and left spaced apart struts, upper and lower spaced apart ribs, and corner trusses. The struts extend from the top wall to the bottom wall, each strut including generally straight upper and lower portions, the spacing between the upper ends of the upper portions either being the same or slightly greater than the spacing between the lower ends of the upper portions, and the lower portions of the struts extending downwardly and outwardly from the upper portions. The upper and lower ribs are positioned between the top and bottom walls and extend transversely from one of the side walls to the other side wall. The corner trusses extend from the top wall to each of the side walls at a location disposed above and closely adjacent the upper rib. The seal construction provides controlled stress buildup during transverse compression in order to avoid overstress which could shorten seal life.

18 Claims, 2 Drawing Figures

ELASTOMERIC SEALING MEMBER

BACKGROUND OF THE INVENTION

This invention relates to sealing members adapted to seal joints and structure elements, and more particularly to an elastomeric sealing member having an elongated tubular body and incorporating a plurality of internally arranged support members to provide a desired loading profile.

The provision of expansion joints in roadways, bridges, pedestrian concourses, airport runways, and the like, is well known. The joints are provided to permit expansion and contraction of the structural elements as ambient temperatures change. In order to bridge the space defined by the edges of the joint, and thereby to prevent the entry into the joint of moisture and of various types of solid debris, which could cause damage both to the underlying base and also possible damage to the sides of the joint itself upon expansion of the structural elements, resilient elastomeric expansion sealing members have been provided which are capable of resiliently expanding and contracting with the joint.

A myriad of elongated seal configurations have been developed over the years for use in expansion joints of structural elements to provide the desired characteristics of sealing over an intended expansion range, depending upon the particular structural elements to be sealed. In actual use, however, the allowable transverse compressibility of such a seal is limited in order to prolong seal life and to prevent deterioration and ultimate failure of the seal because of repeated overcompression. In such cases where limitations are imposed on the degree of excursion over which the seal can be utilized, the particular application may require providing a larger joint space in order to accommodate a larger sealing element which is capable of meeting the loading requirements. Such an approach, however, involves an increase in cost, both for the additional steps involved in enlarging the expansion joint, and also because of the greater volume of seal material required for sealing such an enlarged joint.

BRIEF SUMMARY OF THE INVENTION

It is an object of the present invention to provide an improved elastomeric sealing member which is capable of relatively large deflections while remaining in a relatively low state of stress over the deflection range involved.

It is another object of the present invention to provide an elastomeric sealing member wherein high initial joint sealing pressures are provided against the sides of the joint to prevent the entry of moisture and debris into the joint space when the joint is in its most open condition.

It is a further object of the present invention to provide an elastomeric sealing member which may be readily extruded and vulcanized in large quantities, the design of which is applicable to a variety of seal sizes.

It is still a further object of the present invention to provide an elastomeric sealing member which imposes sufficient pressure against the sides of the joint at the most open condition, and which also involves lower sealing member internal stresses throughout the movement range of the joint to thereby increase the life of the sealing member.

Briefly stated, in accordance with one aspect of the present invention, a resilient sealing member is provided and is positionable in an expansion joint for use in sealing the same over its movement range. The sealing member includes an elongated tubular body portion having an indefinite length which is determined by the length of the joint into which it is to be installed. The sealing member has a substantially uniform cross section throughout its length and includes a plurality of interconnecting internal support members, which provide support to the tubular body and also provide controlled resistance to compression in a direction transverse to its length. The body includes a top wall, a bottom wall, and opposed side walls, each of the side walls being adapted to tightly bear against the sides of the joint. The top and bottom walls include downwardly directed V-shaped portions to cause deflection thereof to occur in a downward direction when compressive forces are applied to the side walls. The internal support members include right and left spaced apart struts, upper and lower spaced apart ribs, and corner trusses. The struts extend from the top wall to the bottom wall, each strut including generally straight upper and lower portions, the spacing between the upper ends of the upper portions either being the same or, preferably, being greater than the spacing between the lower ends of the upper portions, and the lower portions of the struts extending downwardly and outwardly from the upper portions. The upper and lower ribs are positioned between the top and bottom walls and extend transversely from one of the side walls to the other side wall. The corner trusses extend from the top wall to each of the side walls at a location disposed above and closely adjacent the upper rib. The support members maintain substantially uniform pressure along the side walls of the joint during compression of the seal and resist undue vertical deflection.

DESCRIPTION OF THE PREFERRED EMBODIMENT

Figure 1:
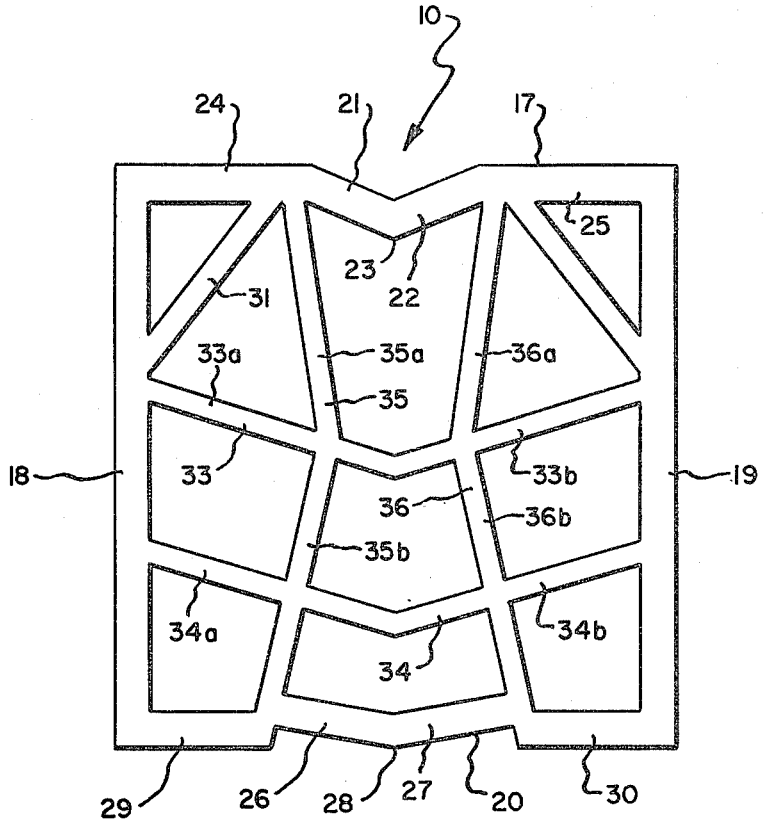
FIG. 1 is a cross-sectional view of an elastomeric sealing member in accordance with the present invention, the seal being shown generally to scale and in an uncompressed state.

Referring now to the drawing, there is shown a sealing member 10 according to the present invention positioned in a roadway joint defined by vertically extending joint side walls 11, 12. It is to be understood that the sealing member shown is of indefinite length, the length being dependent upon the length of the joint in which it is to be installed.

The joint shown is that of a concrete roadway defined by spaced, substantially coplanar roadway surfaces 13, 14. The vertical thickness of the roadway is of the order of several inches or so and joint side walls 11, 12 can be defined by the ends of successive roadway sections as poured, after the forms are removed, or they can be cut by means of known concrete saws, or they can be defined by metallic edge members of a type well known to those skilled in the art. The elastomeric seal member of the present invention is suitable for use with any of the joint edge structures mentioned above. Additionally, joint side walls 11, 12 shown each include an inwardly extending step 15, 16, respectively, which is positioned a predetermined distance below roadway surfaces 13, 14, respectively, for vertically positioning and restraining seal member 10. If desired, the joint can be defined only by side walls 11, 12 and without steps 15, 16.

Sealing member 10 can be formed from a variety of materials of an elastomeric nature such as, for example, natural rubber, neoprene rubber, silicone rubber, or any of a variety of other elastomeric materials which are extrudable, which are sufficiently resistive to chemical and oxidative attack, and which have sufficient resiliency within the temperature ranges in which the sealing member is expected to operate. Preferably, however, neoprene rubber is utilized in forming the sealing member since it exhibits the desired resistance to chemical and oxidative attack, and also operates effectively in the range of temperatures to which such sealing members are normally exposed.

As shown, sealing member 10 includes an elongated tubular body having a top wall 17, side walls 18 and 19 and a bottom wall 20. The top wall 17 is so positioned as to extend across and span a joint at a level slightly below the roadway surfaces 13, 14 with which it is to be used. The pair of opposed, flat side walls 18, 19 each depends downwardly a predetermined distance from an end of top wall 17, the distance which can be approximately the same as the width of top wall 17. The lower ends of the respective side walls 18, 19 are joined by the bottom wall 20 to provide a generally rectangular overall cross section. Preferably, top wall 17, bottom wall 20, and side walls 18, 19 are of the same thickness, but, if desired, they can be made so that one or more of the walls has a thickness which differs from that of one or more of the remaining walls.

Each of top wall 17 and bottom wall 20 includes a generally downwardly directed portion in order to cause deflection thereof to occur in a downward direction when transverse compressive forces are applied to sealing member 10. In the illustrated preferred embodiment, each of the top and bottom walls 17 and 20 includes a downwardly directed V-shaped portion disposed between adjacent generally horizontal portions. The V-shaped portion of the top wall 17 includes two legs 21, 22 which join at an apex 23, the legs 21 and 22 forming the V-shaped portion. The horizontal portions are indicated at 24 and 25. As can be seen from the drawings the V-shaped portion 21, 22 is of substantially the same length as each of the horizontal portions 24, 25. In the bottom wall the V-shaped portion is formed by legs 26 and 27 joining at apex 28. As can be seen, the legs 26 and 27 are in general spaced above the adjacent horizontal portions 29 and 30, only the apex 28 lying in the plane of the horizontal portions 29 and 30.

Positioned interiorly of the tubular body of sealing member 10 are a plurality of interconnecting internal support members which reinforce the top, side and bottom walls thereof and impart the desired operating characteristics to the sealing member. The internal support members conclude a pair of opposed trusses 31, 32, upper and lower spaced apart ribs 33, 34, and right and left spaced apart struts 35, 36.

The trusses 31, 32 are positioned at each upper corner of the sealing member 10 adjacent the intersections of the top wall 17 and the side walls 18 and 19. The purpose of the supporting trusses 31, 32 is to provide vertical support to the top wall in order to resist vertical forces which would otherwise tend to deflect top wall 17 excessively, and also to provide additional support to side walls 18 and 19, with the ribs 33, 34, to equalize the pressure therealong so that the same are held in substantially uniform tight relationship to joint side walls 11, 12, respectively. Thus, it can be seen that the upper ends of the trusses 31, 32 join the top wall to the sides of the intersection of the V-shaped portion 21, 22 with the horizontal portions 24, 25. It can also be seen that the lower end of each of the trusses joins the side wall between the ends at a location spaced below the top wall a distance approximately equal to the length of the associated horizontal portion 24, 25, and just above the ends of the top rib 33.

The ribs 33, 34 extend transversely across the sealing member from side wall 18 to side wall 19. Each of these ribs is preferably formed to two generally straight elements 33*a*, 33*b* or 34*a* and 34*b*, the elements in turn forming a generally downwardly directed V-shaped structure. The elements 33*a* and 33*b* are also preferably parallel to elements 34*a*, and 34*b*, respectively. The ends of the upper rib 33 join the side walls 18 and 19 at locations closely adjacent the lower end of the associated trusses 31, 32, respectively, and above the midpoint of the side walls 18, 19. The ends of the lower rib join the side walls at locations generally midway between the ends of the upper rib and the bottom of the side walls, the ends of the lower rib thus being below the midpoint of the side walls 18, 19. The downward orientation of the V-shaped ribs 33, 34 is provided to insure that deflection of the ribs is in a downward direction when compressive forces are applied to side walls 18 and 19 of the sealing member 10. The spacing between the ribs is so selected as to insure relatively uniform compressive loading on the side walls 18 and 19 and also to insure that as the seal 10 is compressed to its full extent that the voids within the seal will be uniformly filled up to its maximum compression ratio.

In order to provide greater stability to the seal it is necessary that internal generally vertically extending struts be provided. To this end, right and left spaced apart struts 35 and 36 are provided, the struts extending between the top wall 17 and the bottom wall 20. Each strut has generally straight upper and lower portions, the upper portions being indicated at 35*a* and 36*a*. As can be seen the upper ends of the upper portions 35*a* and 36*a* join the top wall at a location closely adjacent the corresponding ends of the associated trusses 31, 32. As illustrated the spacing between the upper ends is greater than the spacing between the lower ends of the upper portions 35*a* and 36*a*. However, the spacing between the upper ends of portions 35*a* and 36*a* could be the same as the spacing between their lower ends. The lower portions 35*b*, 36*b* of the struts 35 and 36 extend downwardly and outwardly from the upper rib 33 to the bottom wall, the lower ends of the lower portions 35*b* and 36*b* intersecting the ends of the V-shaped portion 26, 27 of the lower wall and the adjacent ends of the horizontal portions 29 and 30. It should be noted that the struts 35 and 36 in addition provide vertical support to the center section of the top wall to prevent excessive deflection when vertical loads are applied to the sealing member 10.

Preferably, the interior support members 31–36, are thinner than top wall 17, bottom wall 20, and side walls 18, 19 for several reasons. First, the thinner inner struts provide a more economical seal by utilizing less material. Secondly, thinner inner struts result in more interior space to permit a larger travel of side walls 18, 19 toward each other, and thereby permit the seal to be utilized in a joint which undergoes a more substantial size excursion.

Figure 2:
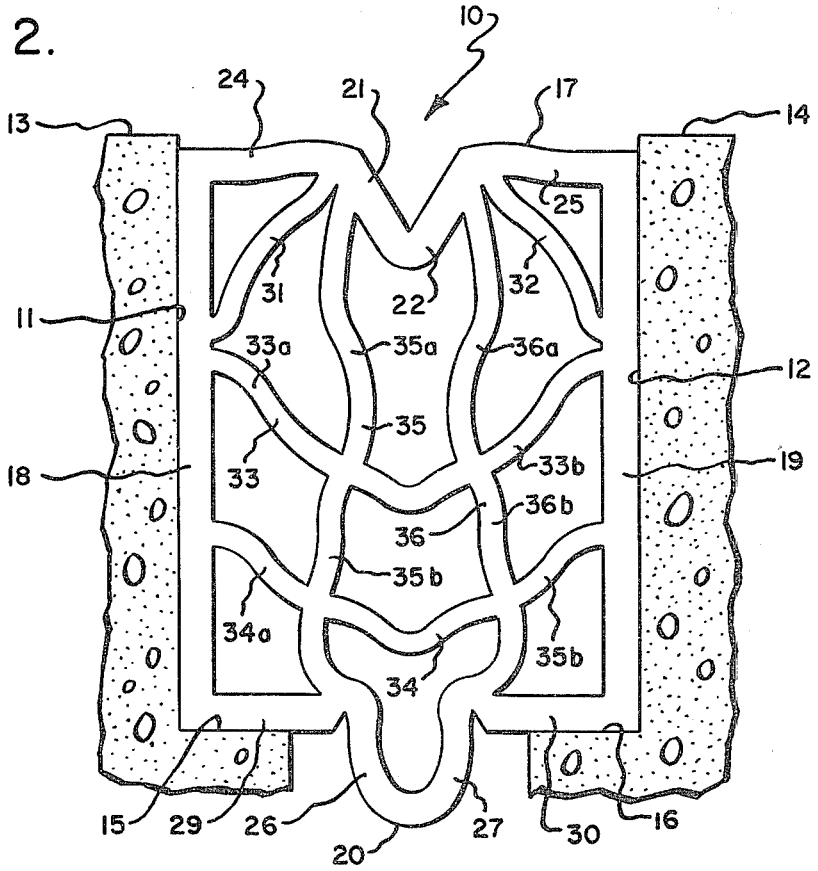
FIG. 2 is a cross-sectional view showing the sealing member of FIG. 1 in place in a concrete roadway joint and with a portion of the roadway broken away for ease of illustration, the pavement members being in partially extended condition wherein the joint spacing is diminished and imposes compressive forces on the sealing member to cause it to assume substantially the cross-sectional configuration shown.

In FIG. 2 there is shown the effect of transverse compression of sealing member 10 of FIG. 1, the compression resulting from expansion of the respective roadway portions, due, for example, to an increase in temperature, which causes joint side walls 11, 12 to move toward each other and thereby compress seal member 10. During the course of compression the seal will assume the configuration shown, and, unless the expansion of the joint-defining elements is limited in some way, the seal will continue to become compressed until the void space has virtually disappeared. At that point the sealing member will act as a solid seal and, unless further compression is avoided, the material will become extremely high stressed, and may cause damage to the joint.

Sealing members of the type shown and described herein are typically suitable for use in a joint having a width range of from about one inch to about five inches. Additionally, the particular design illustrated and described permits a deflection of up to approximately 50% of the original width of the seal without unduly exceeding the internal stress limitations normally imposed on such seals in their operating environment. Furthermore, although described in terms of its use in a roadway expansion joint, it will be apparent that the seal member of the present invention is also suitable for use in building wall joints, walkway joints, concourse joints, bridge deck joints, and the like.

While particular embodiments of the present invention have been illustrated and described, it will be apparent to those skilled in the art that various changes and modifications can be made without departing from the spirit and scope of the invention, and it is intended to cover in the appended claims all such modifications that fall within the scope of the present invention.

What is claimed is:

1. An elastomeric sealing member positionable in an expansion joint for use in sealing the same, said sealing member comprising an elongated tubular body having a length commensurate with the length of the joint to be sealed and having a substantially uniform cross section throughout its length and a plurality of interconnecting internal support members for providing support to said body and for controlling resistance to compression thereof in a direction transverse to its length, said body including a top wall, a bottom wall, and a pair of opposed side walls, each of said side walls being adapted to bear tightly against the sides of said joint, each of said top and bottom walls including downwardly directed V-shaped portions which cause deflection of the associated wall to occur in a downward direction when transverse compression forces are applied to the side walls, the interconnecting internal support members including upper and lower spaced apart ribs and right and left spaced apart struts, the upper and lower spaced apart ribs extending from one side wall to the other and each rib including a generally downwardly directed V-shaped element, the ends of the upper ribs joining the side walls at locations above the midpoint of the side walls and the ends of the lower rib joining the side walls at locations below the midpoint of the side walls, and the right and left spaced apart struts extending between the top wall and the bottom wall, each strut including upper and lower generally straight portions, the upper ends of the upper portions joining the top wall at spaced apart locations and the lower ends of the upper portions joining the upper rib at spaced apart locations between the ends thereof, the spacing between the upper ends of the upper portions of the spaced apart struts either being the same or slightly greater than the spacing between the lower ends of the upper portions, and the lower portions of the struts extending downwardly and outwardly from the upper rib to locations intersecting the bottom wall, the spacing between the upper ends of the lower portions of the spaced apart struts being less than the spacing between the lower ends of the lower portions.

2. The elastomeric sealing member of claim 1 in which the downwardly directed V-shaped portions of the top and bottom walls are disposed between adjacent generally horizontal portions.

3. The elastomeric sealing member of claim 2 wherein the V-shaped portion in the top wall has its upper ends lying in the plane of the adjacent horizontal portions.

4. The elastomeric sealing member of claim 3 wherein the upper ends of the upper portions of the right and left spaced apart struts join the top wall at locations closely adjacent the ends of the V-shaped portion.

5. The elastomeric sealing member of claim 4 wherein the lower ends of the lower portions of the right and left struts intersect the bottom wall at the ends of the V-shaped portion and the ends of the adjacent horizontal portions.

6. The elastomeric sealing member of claim 4 wherein the V-shaped portion in the top wall has an overall width approximately equal to the width of each of the horizontal portions in the top wall.

7. The elastomeric sealing member of claim 4 wherein the V-shaped portion in the lower wall has its apex lying in the plane of the adjacent horizontal portions.

8. The elastomeric sealing member of claim 4 wherein the V-shaped portion in the lower wall has an overall width greater than the V-shaped portion in the top wall.

9. The elastomeric sealing member of claim 4 wherein the spaced apart ribs include only a generally downwardly directed V-shaped element, the ribs being parallel to each other.

10. The elastomeric sealing member set forth in claim 4 further characterized by the provision of a pair of opposed trusses extending between the top wall and the opposed side walls, the upper end of each of the trusses joining the top wall at the juncture of the V-shaped portion with one of the horizontal portions.

11. The elastomeric sealing member as set forth in claim 10 wherein the ends of the upper rib join the side walls at locations closely adjacent the lower end of the associated trusses.

12. The elastomeric sealing member of claim 4 wherein the lower rib joins the side walls at locations generally midway between the ends of the upper rib and the bottom of the side walls.

13. An elastomeric sealing member positionable in an expansion joint for use in sealing the same, said sealing member comprising an elongated tubular body having a length commensurate with the length of the joint to be sealed and having a substantially uniform cross section throughout its length and a plurality of interconnecting, internal support members for providing support to said body and for controlling resistance to compression thereof in a direction transverse to its length, said body including a top wall, a bottom wall, and a pair of opposed side walls, each of said side walls being adapted to bear tightly against the sides of said joint, each of said top and bottom walls including downwardly directed V-shaped portions disposed between adjacent generally horizontal portions, the V-shaped portions causing deflection of the associated wall to occur in a downward direction when transverse compression forces are applied to the side walls, the V-shaped portion in the top wall having its upper ends lying in the plane of the adjacent horizontal portions and also having an overall width approximately equal to the width of each of the horizontal portions, and the V-shaped portion in the lower wall having an overall width greater than the V-shaped portion of the top wall, the interconnecting internal support members including a pair of opposed trusses, upper and lower generally parallel spaced apart ribs, and right and left spaced apart struts, the pair of opposed trusses extending between the top wall and the opposed side walls, the upper end of each of the trusses joining the top wall at the juncture of the V-shaped portion with one of the horizontal portions and the lower end of each of the trusses joining the side wall between the ends thereof at a location spaced below the top wall a distance approximately equal to or slightly less than the length of one of the horizontal portions in the top wall, the upper and lower generally parallel spaced apart ribs extending from one side wall to the other, each rib including a generally downwardly directed V-shaped element, the ends of the upper rib joining the side walls at locations above the midpoint of the side walls and closely adjacent the lower end of the associated trusses, and the ends of the lower rib joining the side walls at locations generally midway between the ends of the upper rib and the bottom of the side walls, and the right and left spaced apart struts extending between the top wall and the bottom wall, each strut including upper and lower generally straight portions, the upper ends of the upper portions joining the V-shaped portion of the top wall at a location closely adjacent the upper end of the associated truss, the lower ends of the upper portions joining the upper rib at spaced apart locations between the ends thereof, the spacing between the upper ends of the upper portions of the right and left struts either being the same or slightly greater than the spacing between the lower ends of the upper portions, and the lower portions of the struts extending downwardly and outwardly from the upper rib to locations intersecting the ends of the V-shaped portion and adjacent ends of the horizontal portions of the bottom wall, the spacing between the upper ends of the lower portions of the spaced apart struts being less than the spacing between the lower ends of the lower portions.

14. The elastomeric sealing member of claim 13 wherein the V-shaped portion of the bottom wall has its apex lying in the plane of the adjacent horizontal portions.

15. The elastomeric sealing member of claim 13 wherein the spaced apart ribs are generally parallel to each other.

16. The elastomeric sealing member as set forth in claim 13 wherein the lower end of each of the trusses joins the adjacent side wall at a location spaced slightly above the ends of the upper rib.

17. The elastomeric sealing member of claim 16 wherein the lower end of each of the trusses is spaced down from the top wall a distance approximately equal to or slightly less than the length of the horizontal portion of the top wall.

18. An elastomeric sealing member positionable in an expansion joint for use in sealing the same, said sealing member comprising an elongated tubular body having a length commensurate with the length of the joint to be sealed and having a substantially uniform cross section throughout its length and a plurality of interconnecting, internal support members for providing support to said body and for controlling resistance to compression thereof in a direction transverse to its length, said body including a top wall, a bottom wall, and a pair of opposed side walls, each of said side walls being adapted to bear tightly against the sides of said joint, each of said top and bottom walls including downwardly directed V-shaped portions disposed between adjacent generally horizontal portions, the V-shaped portions causing deflection of the associated wall to occur in a downward direction when transverse compression forces are applied to the side walls, the V-shaped portion in the top wall having its upper ends lying in the plane of the adjacent horizontal portions and also having an overall width approximately equal to the width of each of the horizontal portions, and the V-shaped portion in the lower wall having its apex lying in the plane of the adjacent horizontal portions and also having an overall width greater than the V-shaped portion of the top wall, the interconnecting internal support members including a pair of opposed trusses, upper and lower generally parallel spaced apart ribs, and right and left spaced apart struts, the pair of opposed trusses exending between the top wall and the opposed side walls, the upper end of each of the trusses joining the top wall at the juncture at the V-shaped portion with one of the horizontal portions and the lower end of each of the trusses joining the side wall at a location spaced below the top wall a distance approximately equal to or slightly less than the length of the horizontal portion, the upper and lower generally parallel spaced apart ribs extending from one side wall to the other, each rib being a generally downwardly directed V-shaped element, the ends of the upper rib joining the side walls at locations closely adjacent the lower end of the associated trusses, and the ends of the lower rib joining the side walls at locations generally midway between the ends of the upper rib and the bottom of the side walls, and the right and left spaced apart struts extending between the top wall and the bottom wall, each strut including upper and lower generally straight portions, the upper ends of the upper portions joining the V-shaped portion of the top wall at a location closely adjacent the upper end of the associated truss, the lower ends of the upper portions joining the upper rib at spaced apart locations between the ends thereof, the spacing between the upper ends of the upper portions of the right and left struts either being the same or slightly greater than the spacing between the lower ends of the upper portions, and the lower portions of the struts extending downwardly and outwardly from the upper rib to locations intersecting the ends of the V-shaped portion and the horizontal portions of the bottom wall, the spacing between the upper ends of the lower portions of the spaced apart struts being less than the spacing between the lower ends of the lower portions.

* * * * *